US009745978B2

(12) United States Patent
Kobus et al.

(10) Patent No.: US 9,745,978 B2
(45) Date of Patent: Aug. 29, 2017

(54) HOUSING FOR A ROTARY VANE PUMP

(71) Applicant: Pfeiffer Vacuum GmbH, Asslar (DE)

(72) Inventors: Christopher Kobus, Graevenwiesbach (DE); Kevin Schneider, Giessen (DE)

(73) Assignee: Pfeiffer Vacuum GmbH, Asslar (DE)

( * ) Notice: Subject to any disclaimer, the term of this patent is extended or adjusted under 35 U.S.C. 154(b) by 169 days.

(21) Appl. No.: 14/538,107

(22) Filed: Nov. 11, 2014

(65) Prior Publication Data

US 2015/0139845 A1 May 21, 2015

(30) Foreign Application Priority Data

Nov. 18, 2013 (DE) ..... 10 2013 112 704

(51) Int. Cl.

| | |
|---|---|
| ***F03C 4/00*** | (2006.01) |
| ***F04C 2/00*** | (2006.01) |
| ***F04C 15/00*** | (2006.01) |
| ***F04C 18/344*** | (2006.01) |
| ***F04C 2/344*** | (2006.01) |
| ***F04C 29/04*** | (2006.01) |
| ***F04C 29/12*** | (2006.01) |
| ***F04C 18/12*** | (2006.01) |
| ***F01C 21/10*** | (2006.01) |

(52) U.S. Cl.

CPC ..... *F04C 15/0096* (2013.01); *F01C 21/10* (2013.01); *F04C 2/344* (2013.01); *F04C 18/126* (2013.01); *F04C 18/344* (2013.01); *F04C 29/04* (2013.01); *F04C 29/12* (2013.01); *F04C 2240/30* (2013.01); *F04C 2250/101* (2013.01); *F04C 2250/102* (2013.01)

(58) Field of Classification Search

CPC ..... F01C 21/08; F01C 21/10; F04C 2/086; F04C 2/344; F04C 18/086; F04C 18/344; F04C 2240/30; F04C 2250/101; F04C 2250/102

USPC ..... 418/132–133, 259, 266–268

See application file for complete search history.

(56) References Cited

U.S. PATENT DOCUMENTS

| | | | | |
|---|---|---|---|---|
| 2,940,661 A | | 6/1960 | Lorenz | |
| 4,659,298 A | * | 4/1987 | Byram | F01C 21/0845 418/253 |
| 4,758,140 A | | 7/1988 | Durach | |
| 5,131,829 A | | 7/1992 | Hampton | |
| 5,702,240 A | | 12/1997 | O'Neal | |

(Continued)

FOREIGN PATENT DOCUMENTS

| | | |
|---|---|---|
| DE | 11 22 664 | 1/1962 |
| EP | 2042 739 A1 | 4/2009 |

(Continued)

*Primary Examiner* — Theresa Trieu

(74) *Attorney, Agent, or Firm* — Abelman, Frayne & Schwab

(57) ABSTRACT

A housing for a rotary vane pump includes a suction flange and a discharge flange having a multi-angular cross-section with at least two sides extending parallel to each other, cooling ribs provided on an outer surface of the housing, with the number of cooling ribs in the region with a high internal pressure being greater than a number of cooling ribs in the region with a low internal pressure, inlet and outlet, with the inlet cross-section being greater than the outlet cross-section, and connection elements provided on the housing and each having two installation surfaces connected by a connection surface.

5 Claims, 8 Drawing Sheets

(56) References Cited

U.S. PATENT DOCUMENTS

| | | | | |
|---|---|---|---|---|
| 6,203,297 | B1 * | 3/2001 | Patel | F04C 2/18 418/206.1 |
| 6,364,642 | B1 | 4/2002 | Garczorz | |
| 6,439,865 | B1 | 8/2002 | Garczorz | |
| 6,544,020 | B1 | 4/2003 | Bahnen | |
| 8,590,324 | B2 | 11/2013 | Guo | |
| 2014/0099226 | A1 | 4/2014 | Eybergen | |

FOREIGN PATENT DOCUMENTS

| | | |
|---|---|---|
| WO | 2007030898 | 3/2007 |
| WO | 2007107514 | 9/2007 |

* cited by examiner

HOUSING FOR A ROTARY VANE PUMP

BACKGROUND OF THE INVENTION

1. Field of the Invention

The present invention relates to a housing for a rotary vane pump having a suction flange and a discharge flange.

2. Description of the Prior Art

Rotary vane pumps are well known. In a rotary vane pump, two rotors synchronously rotate in a housing in opposite directions, without contacting each other. The rotors can have a shape of 8 and are separated from each other and from the stator by a narrow gap. The forwarded gas is transmitted from the suction opening to the discharge opening.

A shaft is driven by a motor. The synchronization of the other shaft is carried out with a tooth gear pair located in the drive space. Lubrication is limited to the drive space separated from the compression chamber by a sealing element.

Because no friction takes place in the compression chamber, the rotary vane pump can be operated with a high speed up to 7,500 revolution/min. The symmetrical mass distribution of the rotors about the shaft axis provides for a perfect dynamic balance, so that the pump operates quietly, despite the large rotational speed.

The rotor shaft bearings are located in two side portions of the housing. The bearing on one side is preferably a fixed bearing, and the bearing on the other side is formed as a floating bearing to provide for non-uniform thermal expansion of the housing and the pistons. Usually, oil is used for lubrication of bearings and the tooth gears. At standard executions, the drive shaft portions that project outwardly, are sealed with sealing oil superimposed, radial shaft seals for shaft protection, the seal ring can rotate on a wearing sleeve that can be replaced.

The object of the invention is to improve state-of-the art rotary vane pumps by a new design of the rotary vane pump housing.

SUMMARY OF THE INVENTION

The object of the invention is achieved with a housing for a rotary vane pump comprising a suction flange, a discharge flange, and a plurality of cooling ribs provided on an outer side of the housing, wherein a number of cooling ribs in a region of the housing in which in an interior of the housing, a greater compression of a to-be-pumped medium takes place, is greater than a number of cooling ribs in a region of the housing in which in the interior of the housing, a smaller compression of the to-be-pumped medium takes place.

The evacuation chamber adjoins the suction side. In this chamber, a smaller pressure prevails then on the discharge side of the pump. Because the compression is greater on the discharge side, a noticeably higher temperature prevails on the discharge side than on the suction side. In order to prevent tensions and deformations that would exist in the housing because of temperature gradients, the inventive housing is provided with a greater number of cooling ribs in the region of the housing in which a greater compression takes place, then in the region of the housing in which a smaller compression of the to-be-pumped medium takes place. Because of the uniform cooling of the housing, hardly any tension or deformations occur in the housing. Thereby, the displacement of bearing locations which takes place upon occurring of large deformation, is prevented.

According to an advantageous embodiment of the present invention, a greater number of cooling ribs is provided in the region of the discharge flange than in the region of the suction flange. As it follows form the discussion above, the pressure of the to be pumped medium which prevails in the region of the suction flange, substantially corresponds to the pressure in the to-be-evacuated recipient. In the discharge region, the compression of the to-be-pumped medium is noticeably greater, so here greater temperatures are observed. Therefore, it makes sense to provide more cooling ribs in this region then in the suction region.

According to a further advantageous embodiment of the invention, the housing is formed as a one-piece housing having in cross-section, a first portion including the suction flange, and a second portion including the discharge flange with the first portion having a smaller number of the cooling ribs than the second portion of the housing. Here again, it is achieved that the housing portion with essentially higher temperatures is better cooled by the greater number of cooling ribs. I.e., the temperatures which are caused by compression, are better removed outwardly.

According to a further advantageous embodiment of the invention, the cooling ribs are arranged, in the radial direction, along envelope lines of the housing. Thereby, annular or part-annular cooling ribs, around which air could easily flow, can be obtained. The cooling ribs can, e.g., be formed half-annular.

According to a still further advantageous embodiment of the invention, the number of cooling ribs in the region of the housing in which the interior of the housing, a greater compression of a to-be-pumped medium takes place, is at least twice or thrice greater than the number of cooling ribs in the region of the housing in which in the interior of the housing, a smaller compression of the to-be-pumped medium takes place.

There exists a possibility, e.g., to provide only a single cooling rib in the region of a smaller compression and to provide two, three, four, five or even more cooling ribs in the region of greater compression.

The asymmetrical cooling resulting from different number of cooling ribs in regions with greater and smaller compression provides for a better performance density of a rotary vane pump, so that the rotary vane pump can be made smaller and, in addition, a better heat removal becomes possible. Thereby, a small, high-performance, compact pump can be obtained.

The object of the invention is also achieved by providing a housing for a rotary vane pump, comprising a suction flange, a discharge flange, an inlet provided in a region of the suction flange, and an outlet provided in a region of the discharge flange, with a cross-section of the inlet being greater than a cross-section of the outlet.

This construction according to the invention permits to noticeably optimize the energy efficiency at the same volume characteristics. The cross-section at the forevacuum side is, advantageously, at least by 30% and, according to a particular advantageous embodiment of the invention, by about 50% smaller than the cross-section in the high vacuum region.

According to a further, particularly advantageous embodiment of the invention, both the suction flange and the discharge flange each has a circular opening for suction and discharge of a to-be-pumped medium, respectively, that changes into one of rectangular opening and oval opening in a region of an inner wall of the housing.

This formation of the inlet and/or the outlet provides for a flow cross-section of the transition from flange to the compression chamber that is greater than or equal to the cross-section of the flange opening itself. This results in a flow-optimized gas advance from the high-vacuum region to the compression chamber and again to the forevacuum region. This embodiment permits to prevent flow stalling.

According to a yet further advantageous embodiment of the invention, the rectangular or oval opening in the region of the suction flange is formed larger than the rectangular or oval opening in the region of the discharge flange. Here, likewise, the above-described optimized energy efficiency at the same volume characteristics is achieved.

According to a still another advantageous embodiment of the invention, the circular opening in the suction flange is formed larger than the circular opening in the discharge flange. This provides for a greater cross-section on the high-vacuum side than on the forevacuum side.

According to another advantageous embodiment of the invention, the rectangular or oval openings are formed, in a direction perpendicular to a longitudinal axis of the housing, smaller than the diameters of respective circular openings, or the rectangular or oval openings are formed in the direction perpendicular to the longitudinal axis of the housing, of the same size as the diameters of the circular openings.

In a particular advantageous embodiment, the rectangular or oval openings are formed, in the direction transverse to the longitudinal axis of the housing, smaller than the diameters of the circular openings. Advantageously, in the axial direction, the rectangular or oval openings are formed larger than the diameters of the circular openings. A transition from the circular opening in the rectangular or oval opening is provided in the inner wall of the housing. The transition from circular openings in rectangular or oval openings is advantageously smooth. This also prevents stalling.

According to yet another advantageous embodiment of the invention, the outlet of the compression chamber is smaller than the inlet of the compression chamber. Thereby, the reduction of the cross-section of the forevacuum cross-section in comparison with the high vacuum cross-section is achieved.

The inventive housing for a rotary vane pump having a suction flange and a discharge flange, is characterized in that either the suction flange or/and the discharge flange have a multi-angular shape, with at least two opposite sides extending parallel to each other.

This deviation from the known from practice annular flanges has an advantage that consists in that the flange can have a smaller expansion, whereby the entire size of the housing can be reduced.

According to a particular advantageous embodiment of the invention, the suction flange and/or the discharge flange has at least four sides arranged pairwise parallel to each other. Thereby, it becomes possible to tightly connect the flange sides with the housing and form measuring bores in the sides located at 90° to the sides which tightly abut the housing, and which can be formed in straight-formed sides noticeably simpler than in the annular sides, e.g., formed in round flanges.

According to yet another particularly advantageous embodiment of the present invention, the suction flange and/or the discharge flange have rectangular shape or square shape and have in its angular regions recesses. The recesses, advantageously, are formed as radii projecting in the suction flange and/or the discharge flange. This shape is particularly advantageous from the point of view of saving the material and thereby weight reduction. Two sides of the flange which lie parallel to each other, are aligned with the housing flanges on which, e.g., a cover for closing the housing and for through-passing of the rotor-carrying shafts is provided.

The sides, which are offset by 90° with respect to parallel to each other sides, have, advantageously at least one measuring bore The recesses enable, in addition, a better cooling of the housing because a smaller surface of the housing is covered by the flange material.

For a further weight reduction and a better handling of the housing, all edges of sides on which the suction flange and/or the discharge are arranged, are rounded.

At least one uprightly formed side of the suction flange and/or the discharge flange is advantageously formed as a free-lying surface. The advantage of this consists in that measuring bores can be formed on this side. The pressure sensors or temperature sensor can, e.g., be located in these measuring bores.

Advantageously, two measuring bores are provided, respectively, in the flange on the high vacuum sides and two measuring bores are provided, respectively, on the flange on the forevacuum side.

With this embodiment, a flexible attachment of accessories is possible in most constructions, independent in which direction the pump housing is arranged.

The formation of multi-angular, advantageously rectangular, in particularly, square-shaped flanges according to the invention insures, in addition to weight reduction, a simpler casting of the flanges.

A housing for a rotary vane pump having a suction flange and a discharge flange, includes connection elements for securing the housing, wherein the connection elements each has two installation surfaces arranged at a 90° angle to each other, and a connection surface for connecting the two installation surfaces and arranged at a 45° angle to the installation surfaces.

This design of the connection elements makes possible arrangement of the housing for either horizontal operation or vertical operation. The connection elements permit to mount the housing on separate feet, on feet connected with each other, or on a support. The advantage of this inventive embodiment consists in that the transmission of the gravity force over surfaces extending perpendicular to the gravity vector is independent from the installation (mounted) position of the housing. This prevents action of the gravity force on the fastening screws. According to an advantageous embodiment of the invention, at least one bore with an inner thread is provided in the connection surface. In these bores, fastening screws can be located and which extend at an angle of 45° to the horizontal or vertical axis of housing. This prevents the gravity force from acting on the fastening screws.

Advantageously, intersection lines of the installation surfaces and the connection surfaces are formed as bevels. This enables a flat abutment of both contact surfaces which usually consist of an installation surface and a connection surface.

According to a further embodiment of the invention, at least one of the installation surfaces and the connection surface has a bore with an inner thread. Fastening screws can extend through this bore.

According to a still further advantageous embodiment of the invention, wherein the connection elements are provided on a flange formed for vacuum-tightly connecting the housing with a bearing plate. Advantageously, the housing has a flange on which a cover is mounted for vacuum-tightly sealing the housing. Advantageously, the fastening elements are provided on the flange. The advantage of this embodiment consists in that at least one flange forms the outer boundary of the housing without cover and, thereby, insures the most reliable positioning of the housing.

According to another embodiment of the invention, at least one of the suction flange and the discharge flange has a hole pattern for ISO-connection and simultaneously a hole pattern for DIN-connection. In this case, it is particularly advantageous when the housing is formed as a multi-sided housing because the double hole pattern is provided in the same part and, thus, a common part, together with a seal, can be produced, without a need to adapt the parts to customer specifications. Thereby, a flexible manufacturing of DIN or ISO parts, according to the need, becomes possible. The hole patterns are advantageously formed of bores with inner threads in order to be able to connect the connecting flange on the specified side of the suction flange and/or the discharge flange of the inventive housing.

Advantageously, the bores are arranged radially symmetrically in the at least one of the suction flange and the discharge flange. This insures a uniform force transmission upon connection of the respective flange with the connection flange.

The sealing elements are advantageously located in the ISO-hole pattern to insure a reliable sealing independent from the use of ISO- or DIN-holes.

Separate inventive concepts of forming the housing with cooling ribs, with specific relationships of inlet and outlet cross-sections, with suction and/or discharge flanges having multi-angular, rectangular or square shape, as well as with fastening elements can be used separately or be arbitrary combined.

The inventive housing for a rotary vane pump permits to optimize power consumption, efficiency, vacuum characteristics, reliability and service-friendliness. In addition, the inventive embodiments enable to form a compact housing, with regard to its outer dimensions, and which can be easily used, permit to reduce manufacturing costs, and allow an operation with both horizontal and vertical delivery.

The present invention was shown and described with references to the preferred embodiments, such are merely illustrative of the present invention and is not to be construed as a limitation thereof and various modifications of the present invention will be apparent to those skilled in the art. It is therefore not intended that the present invention be limited to the disclosed embodiments or details thereof, and the present invention includes all various and/or alternative embodiments within the spirit and scope of the present invention as defined by the appended claims.

DETAILED DESCRIPTION OF THE PREFERRED EMBODIMENTS

Figure 1:
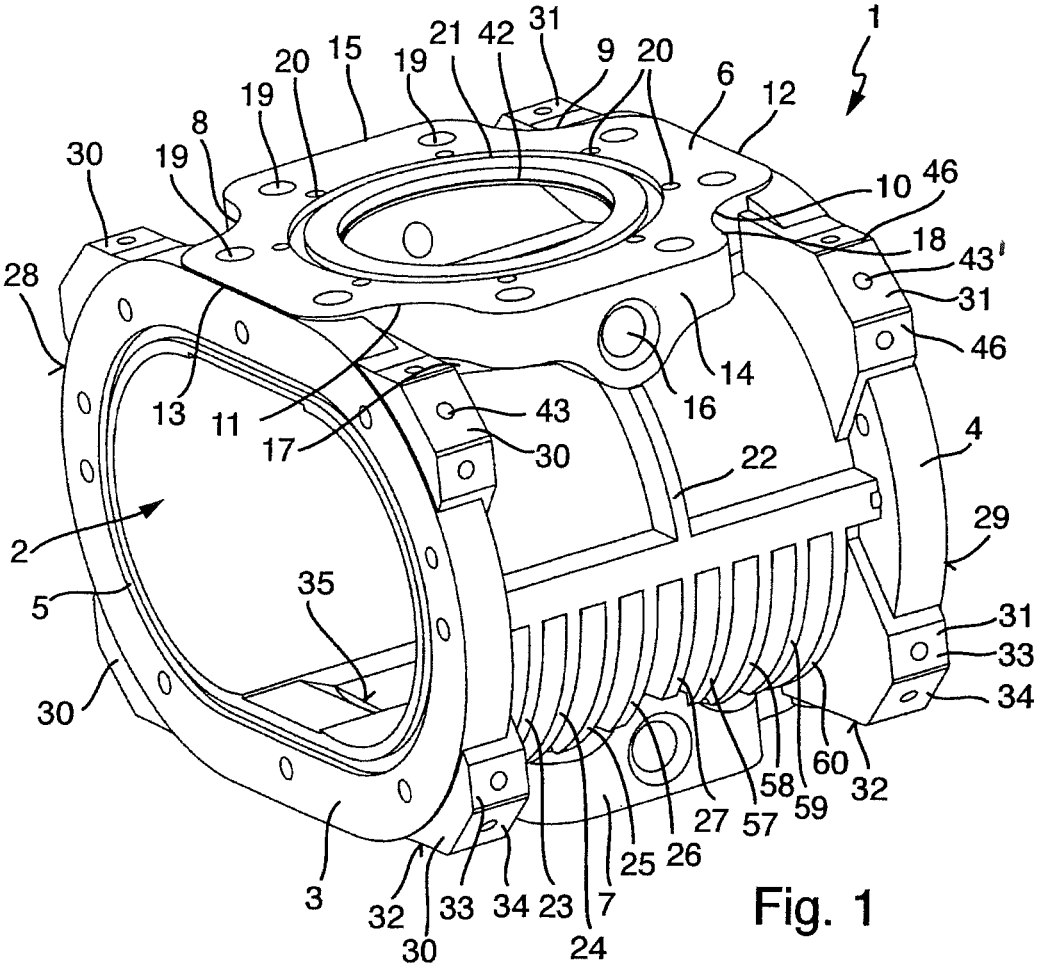
FIG. 1 a perspective view of a housing according to the present invention with a high vacuum connection flange.

FIG. 1 shows a housing 1 of a rotary vane pump. In the compression chamber 2, there are arranged two, not shown, rotors synchronously rotatable, in a non-contact manner, in opposite directions. The rotors have a shape of "8" and are separated from each other and from respective stators by a gap.

Figure 9:
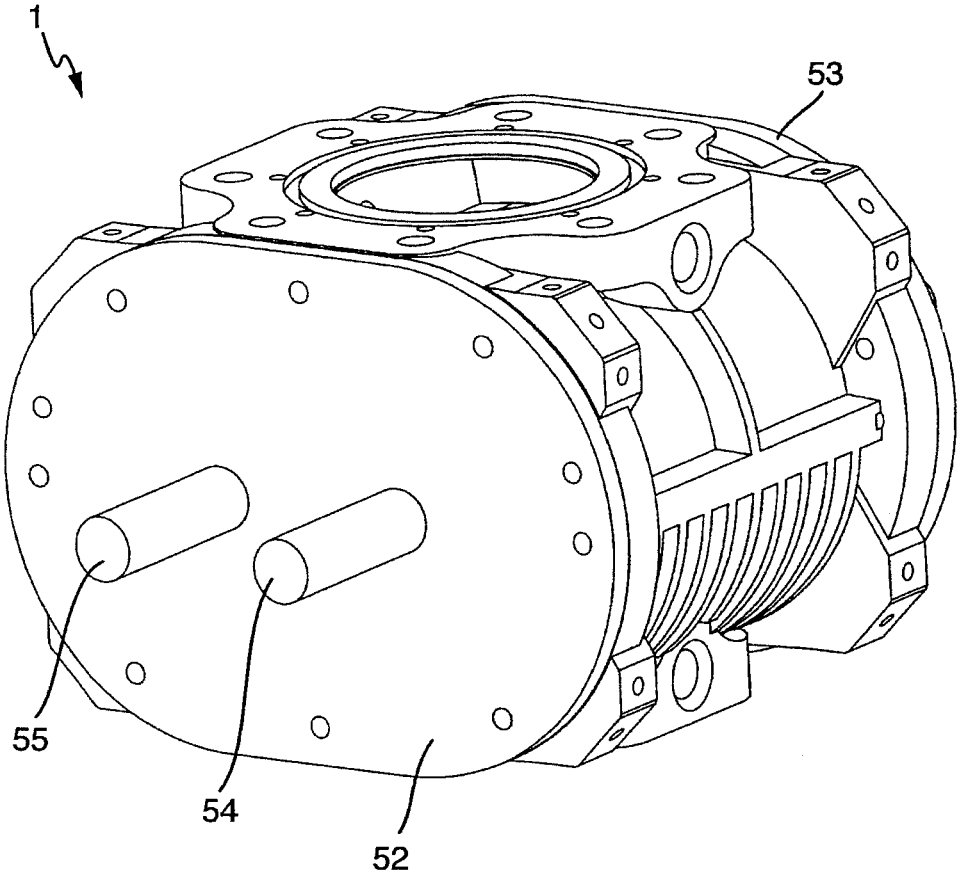
FIG. 9 a perspective view of a housing according to the present invention with a cover.

The housing 1 is shown in FIG. 1. The flanges 3 and 4 are equipped during an operation with covers 52, 53, as shown in FIG. 9, and which tightly abut the flanges 3 and 4. In addition, as shown in FIG. 1, the flange 3 is provided with a groove 5 for receiving a seal. As shown in FIG. 9, shafts 54, 55 for rotors extend through the covers 52, 53.

According to FIG. 1, the housing 1 has a suction flange 6 and a discharge flange 7. The suction flange 6 has a square basic surface in corner regions of which, recesses 8, 9, 10, 11 in form of notches extending into the basic surface of the flange 6 are provided. Sides 12, 13 of the flange 6 extend parallel to each other, can be aligned with the flanges 3, 4 and end, according to FIG. 1, at the end surface of the flanges 3 and 4. The sides 14, 15 of the flange 6 likewise extend parallel to each other. In the sides 14, 15 of the flange 6, measuring boreholes 16 are provided.

The recesses 8, 9, 10, 11 in the basic surface of the flange 6 permit to achieve weight reduction. In addition, the flange 6 can be more easily produced.

Moreover, in the regions 17, 18 of the housing 1 and in the corresponding regions on the opposite side, a better cooling is achieved as these regions are not covered by the flange material.

The construction of the flange 6 with parallel opposite sides 12, 13 also makes possible to form the housing 6 noticeably shorter in the axial direction than was the case with a round flange as the flange should not project beyond the housing.

The flange 6 has two hole patterns. The first hole pattern for DIN-standard consists of bores 19. these bores are arranged in the flange 6 outwardly. The second hole pattern for ISO-standard consists of bores 20. Inwardly of bores 20 provided for the ISO-standard, a groove 21 for O-ring seal is provided to achieve a tight connection upon connection of the flange 6 with a connection flange (not shown).

The housing 1 has cooling ribs 22, 23, 24, 25, 26, 27 and 57, 58, 59, 60. The upper portion 28 of the one-piece housing, i.e., the region in which a smaller compression of the pumping medium takes place, has only one cooling rib 22, whereas a lower portion 29 of the housing 1 has five cooling ribs 23 through 27 and 57 through 60. In the lower portion 29 of the housing 1, the pumping medium is noticeably greater compressed, so that here a much greater temperature is reached than in the upper portion 28. In order to achieve a uniform cooling of the housing, without any temperature gradients, a greater number of cooling ribs 23 through 27, 57 through 60 is provided in the lower portion 29 than in the upper portion 28.

Because of different number of the cooling ribs, tensions and deformations in the housing 1 and, thereby, e.g., displacement of the support points, are prevented or preventable.

The flanges 3, 4 are provided with connection elements 30, 31. The connection elements 30, 31 have installation surfaces 32, 33 arranged at 90° angle towards each other.

The installation surfaces 31, 32 are connected with each other by a connection surface 34. The connection surface 34 is arranged relative to the collection areas at an angle of 45°.

A circular inlet opening 42 is provided in the suction flange 6. Likewise, the discharge flange 7 has a circular opening 35.

Figure 2:
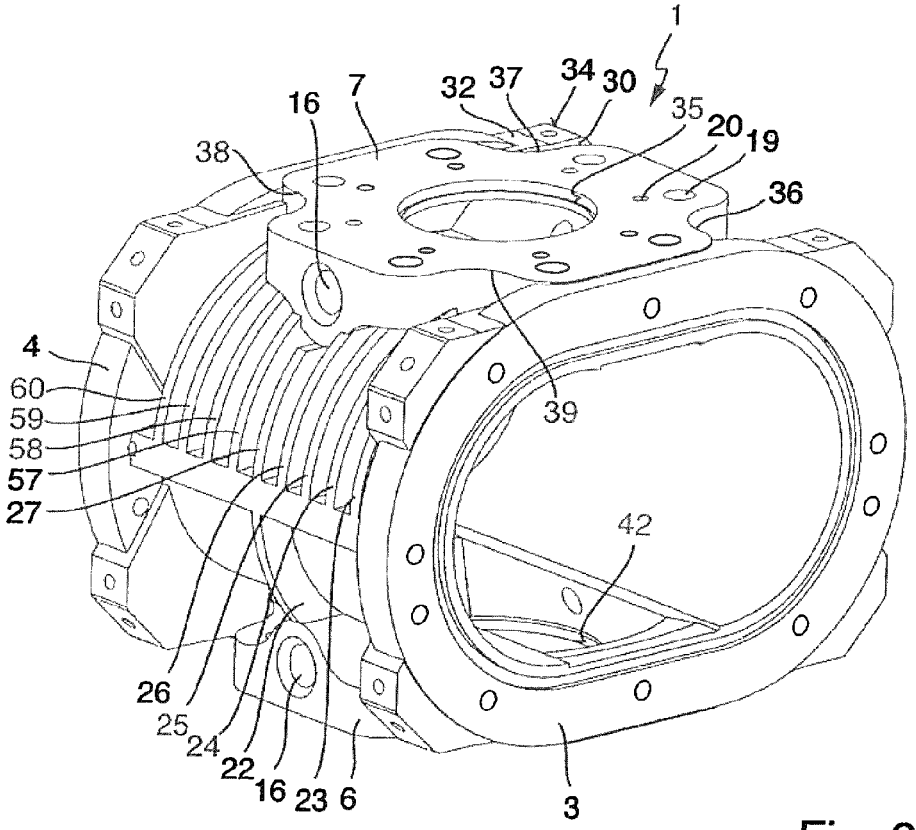
FIG. 2 a perspective view of a housing according to the present invention with a forevacuum connection flange.

FIG. 2 also shows the housing 1. The same components are designated with the same reference numerals. According to FIG. 2, the discharge flange 7 is clearly visible as it is located on top.

The discharge flange 7 has, as the suction flange 6, a basic square shape, and in the corner regions, recesses 36, 37, 38, 39 are formed, as in the flange 6, as inwardly projecting radii.

Figure 3:
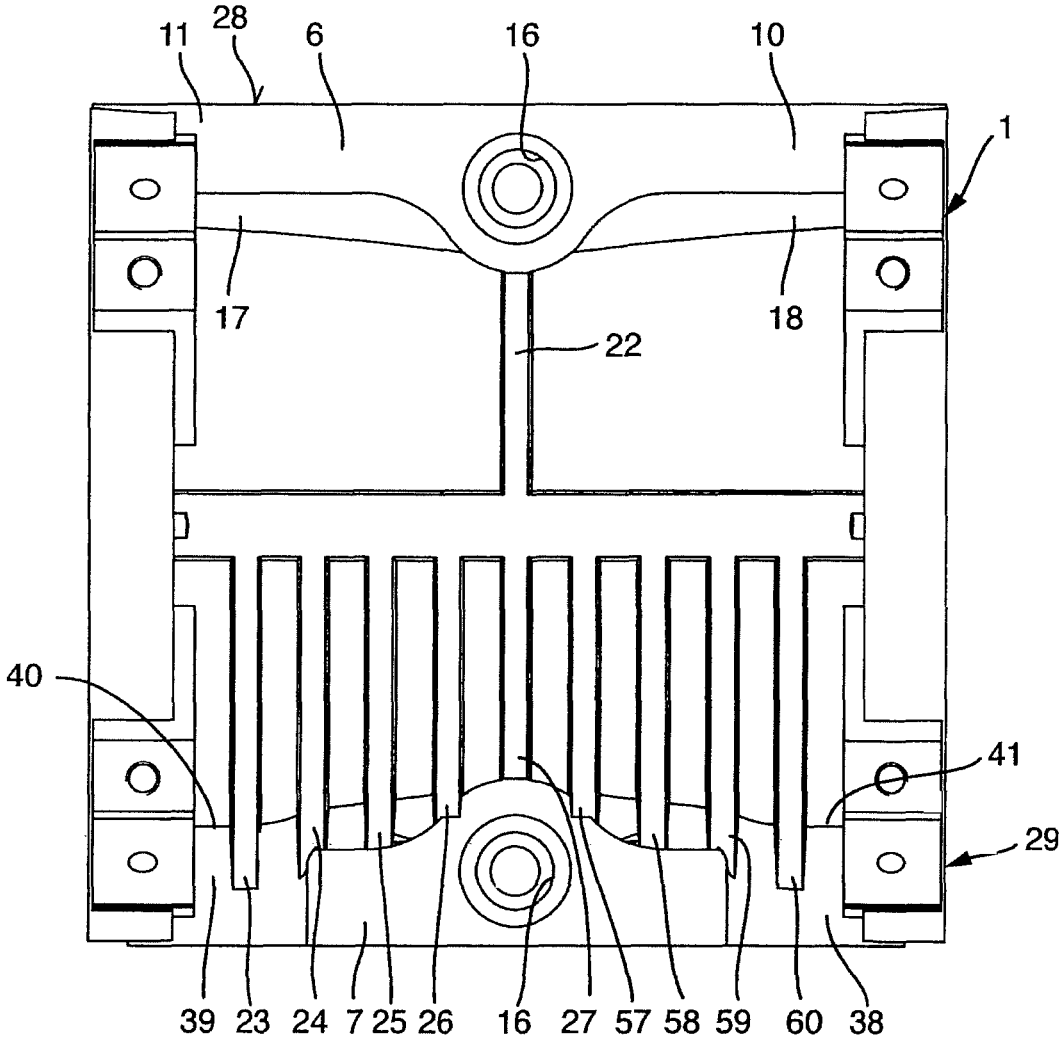
FIG. 3 a side view of the housing.

FIG. 3 shows a side view of the collection areas at an angle of 45°.

A circular inlet opening 34 is provided in the suction flange 6. Likewise, the discharge flange 7 has a circular opening 35.

FIG. 2 also shows the housing 1. The same components are designated with the same reference numerals. According to FIG. 2, the discharge flange 7 is clearly visible as it is located on top.

The discharge flange 7 has, as the suction flange 6, a basic square shape, and in the corner regions, recesses 36, 37, 38, 39, as in the flange 6, as inwardly projecting radii FIG. 3 show a side view of the housing 1, with cooling ribs 22 in the first portion 28 of the housing 1 and cooling ribs 23 through 27 and 57 through 60 in the second portion 29 of the housing 1.

The cooling ribs 22 through 27 and 57 through 60 are arranged radially along the envelope lines of the housing 1. With the recesses 10, 11 in the flange 6 and recesses 38, 39 in the flange 7, the regions 17, 18, 40, 41 of the housing are better cooled than in the absence of the recesses 10, 11.

Figure 4A:
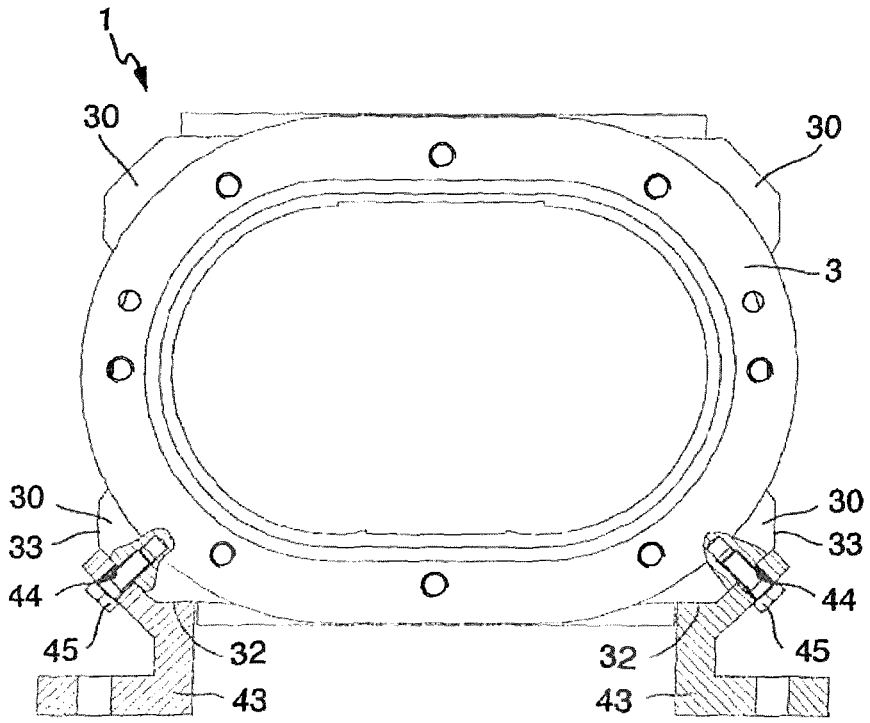
FIG. 4*a* a front elevational view of the housing with separate feet in an axial direction.

FIG. 4*a* shows the housing 1 with the flange 3. On the housing, connection elements 30 are provided which have installation surfaces 32, 33 and the connection surface 34. The installation surfaces are arranged to each other at an angle of 90°, installation surfaces 32, 33 provide for mounting of the housing 1 on a stand or a corresponding fast mounting. In the connection surfaces 34, a bore 43' is provided, respectively, in which a fastening element 45 can be located. The construction prevents action of shearing forces on the fastening elements, e.g., screws.

Figure 4B:
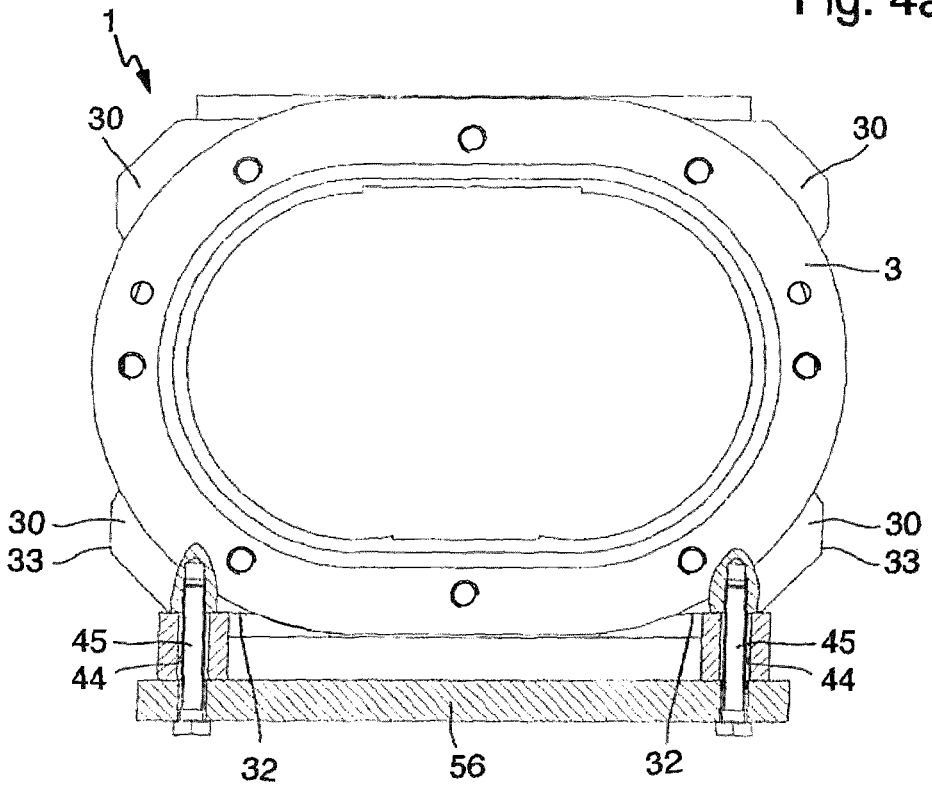
FIG. 4*b* a front elevational view of the housing mounted on a stand in the axial direction.

According to FIG. 4*a*, a foot mounting 43 is provided for each connection element 30. The foot mounting 43 has a through-bore 44 through which a screw 45 engageable in connection element bore having an inner thread, extends. Both fast mountings can be connected to form a common foot mounting or be connected to a stand, as shown in FIG. 4*b*.

Because transmission of the gravity force takes place over surfaces extending transverse to the gravity force, action of the shearing force on the fastening elements, screws 45, is prevented. The housing 1 can also be mounted vertically, using the same foot mounting 43.

The connection elements 30 have, as shown in FIG. 1, face surfaces 46 for insuring a flat abutment of both installation surfaces 32, 33.

Figure 5:
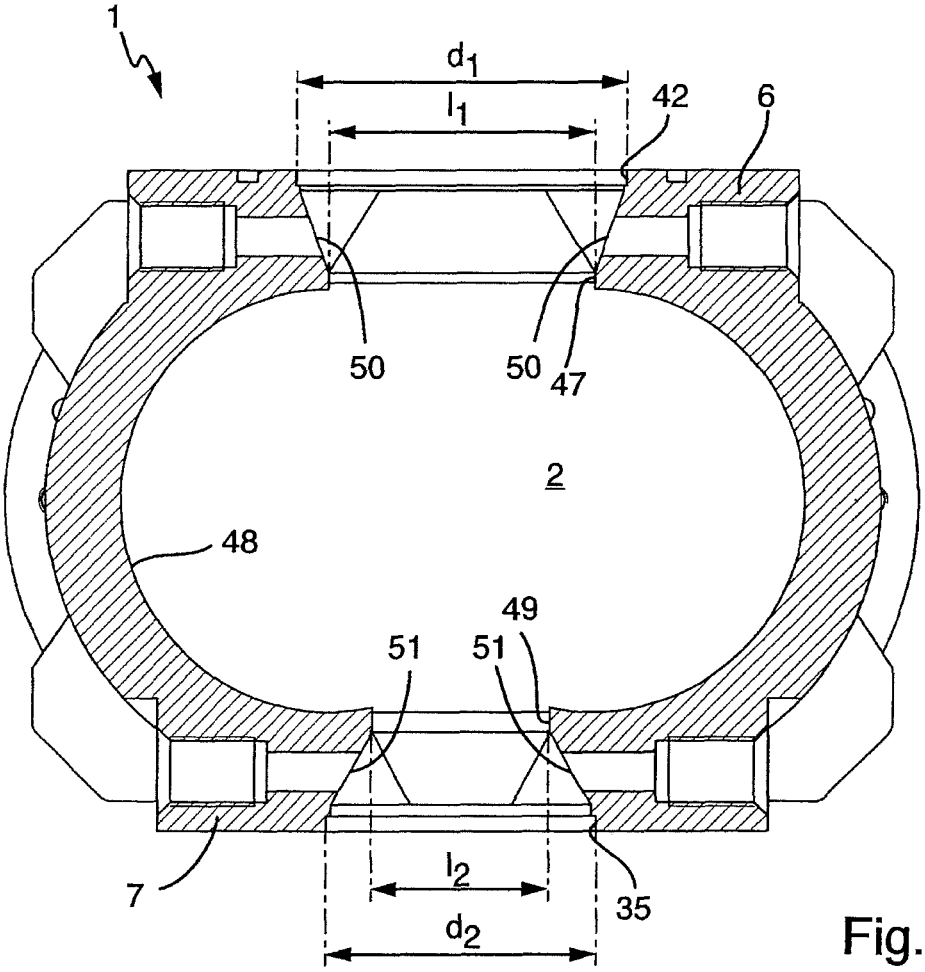
FIG. 5 a cross-sectional view of the housing.

FIG. 5 shows a cross-sectional view of the housing 1 of a vacuum pump.

The housing 1 has a suction flange 6 and a discharge flange 7. The diameter $d_1$ of the suction opening 42 is greater than the diameter $d_2$ of the discharge opening 35 of the flange 7. The opening 42 is preferably circular but changes into a rectangular opening 47 in the region of the inner wall 48. The same occurs with the opening 35 that changes in a rectangular opening 49. In the region of the intersecting planes that is shown in FIG. 5, the transition of the opening 42 in the rectangular opening 47 narrows in the direction of the compression chamber 2 and is formed by side walls 50. The same takes place for the opening 35 that conically narrows in the rectangular opening 47, with the transition being formed by side walls 51. The transition of the openings 35, 42 in the rectangular opening 47, 49 takes place smoothly.

The rectangular opening 47 has, viewing in the direction transverse to the longitudinal axis of the housing 2, a smaller extension $l_1$ than the diameter $d_1$ i.e., $l_1$ is smaller than $d_1$.

The rectangular opening 48 has likewise, viewing in the direction transverse to the longitudinal axis of the housing 2, a smaller extension $l_2$ than the diameter $d_2$ i.e., $l_2$ is smaller than $d_2$.

In addition, the diameter $d_1$ of the opening 42 is greater than the diameter $d_2$ of the opening 35. Also, the extension $l_1$ is greater than extension $l_2$. This means that the forevacuum cross-section is noticeably smaller than the high vacuum cross-section, whereby the energy efficiency is optimized at the same volume characteristic. Advantageously, the forevacuum cross-section is by about 50% smaller than the high vacuum cross-section.

Figure 6:
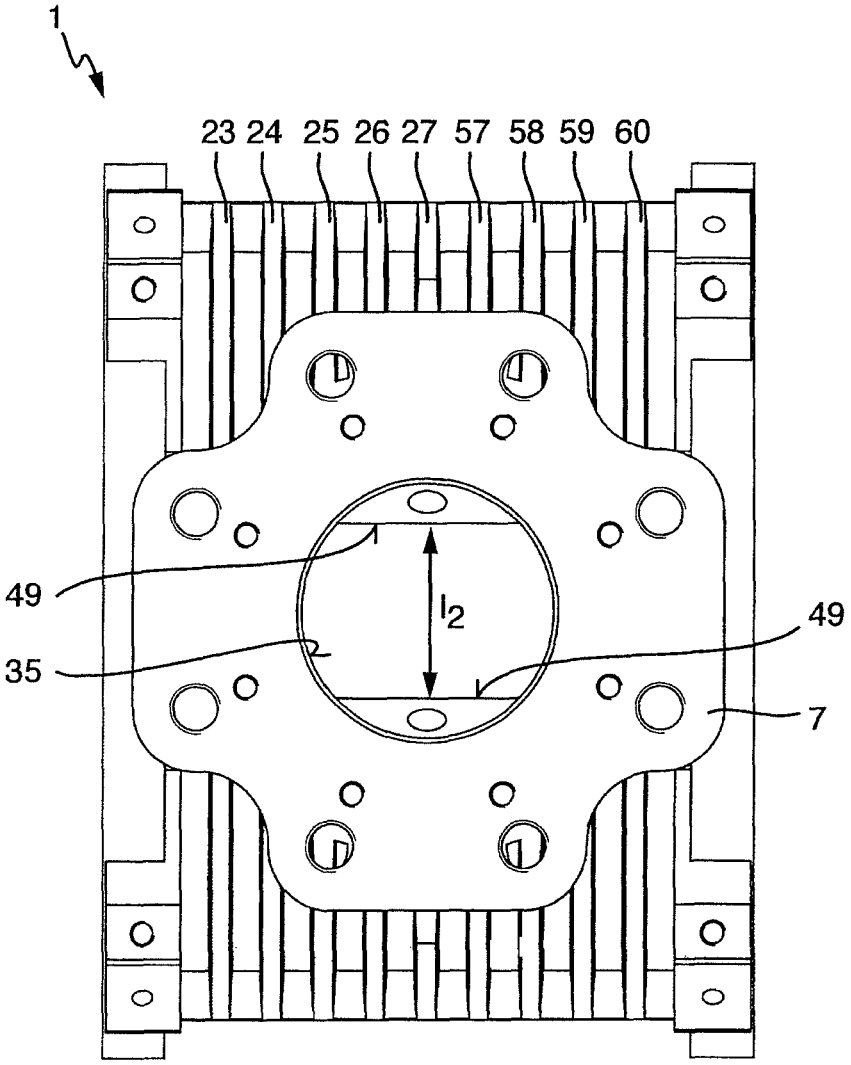
FIG. 6 a bottom view of the housing provided with a discharge flange.

FIG. 6 shows the housing 1 with the discharge flange 7. One can see in FIG. 6, narrowing of the cross-section by formation of the rectangular opening 49.

Figure 7:
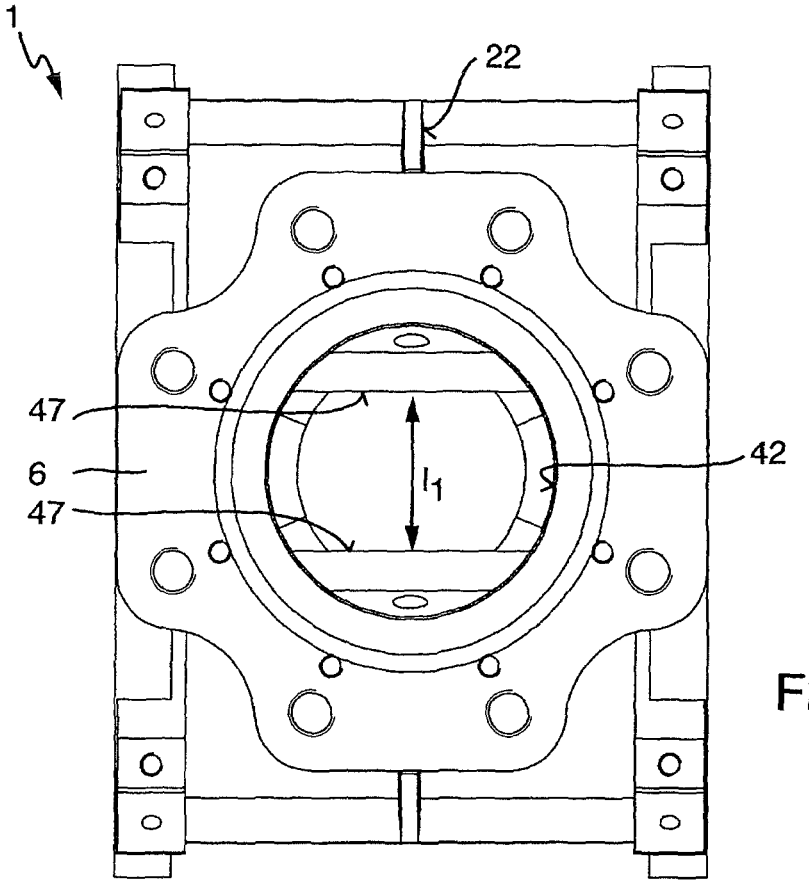
FIG. 7 a top view of the housing provided with a suction flange.

FIG. 7 shows the housing 1 with the suction flange 6. Here also one can see narrowing of the cross-section of the opening 42 by formation of the rectangular opening 49.

Figure 8:
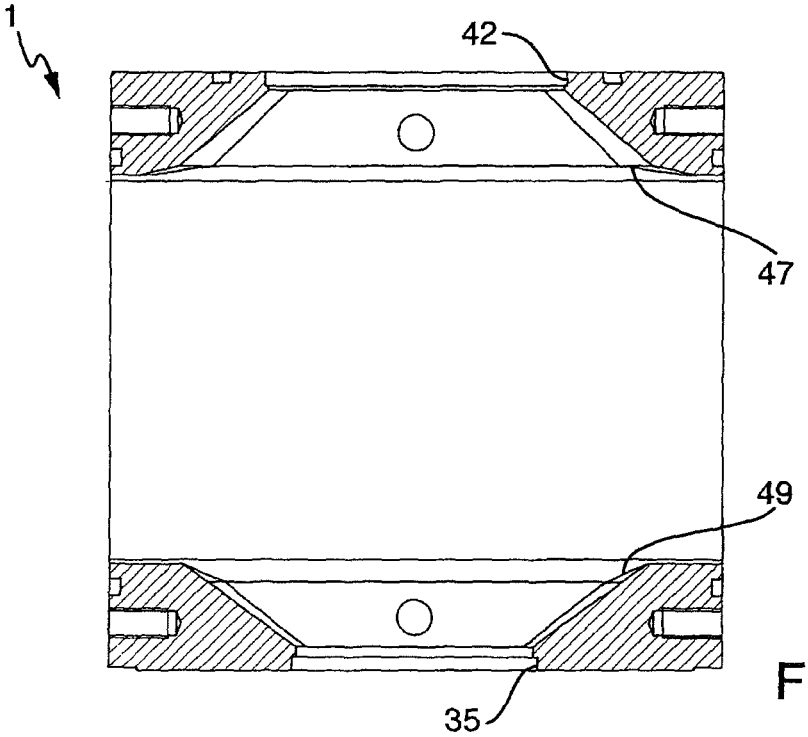
FIG. 8 a longitudinal cross-sectional view of the housing.

FIG. 8 shows a longitudinal cross-sectional view of the housing 1 with the suction opening 42 and the discharge opening 35 which change into rectangular openings 47, 49. Here also one can see a smooth transition that prevents stalling.

FIG. 9 shows the housing 1 with features shown in FIG. 1. According to FIG. 9, the housing is vacuum-tightly closed, from both sides, with a cover 52, 53, respectively. The shafts 54, 55 of the rotors (not shown) extend through the cover 52 (not shown) and the cover 53.

Though the present invention was shown and described with references to the preferred embodiments, those are merely illustrative of the present invention and is not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A housing for a rotary vane pump, comprising a suction flange (6) and a discharge flange (7) located opposite each other; and two additional flanges (3, 4) arranged on opposite axial sides of the housing, respectively, and each having at least two connection elements (30, 31) for securing the housing, the connection elements each having two installation surfaces arranged at a 90°-angle to each other, and a connection surface for connecting the two installation surfaces and arranged at a 45°-angle to the installation surfaces.

2. A housing according to claim 1, wherein intersection lines of the installation surfaces and the connection surfaces are formed as bevels.

3. A housing according to claim 1, wherein at least one of the installation surfaces and the connection surface has a bore with an inner thread.

4. A housing according to claim 1, wherein the additional flanges of the housing each has a cover for vacuum tightly sealing the housing.

5. A housing according to claim 1, wherein at least one of the suction flange and the discharge flange has a hole pattern for ISO-connection and DIN-connection, with the bores being arranged radially symmetrically in the at least one of the suction flange and the discharge flange.

* * * * *